US005787630A

United States Patent [19]

Martel

[11] Patent Number: 5,787,630

[45] Date of Patent: Aug. 4, 1998

[54] SCOPE MOUNTING RING SYSTEM

[76] Inventor: Phillip C. Martel, 43551 Applewood, Canton, Mich. 48188

[21] Appl. No.: 625,964

[22] Filed: Apr. 1, 1996

[51] Int. Cl.[6] ..... F41G 1/387

[52] U.S. Cl. ..... 42/101; 33/247

[58] Field of Search ..... 42/101, 103; 33/245, 33/246, 247, 248, 249, 250; 248/205.1, 231.85, 231.41, 228.3, 230.3

[56] References Cited

U.S. PATENT DOCUMENTS

| | | | |
|---|---|---|---|
| D. 269,450 | 6/1983 | Bechtel . | |
| 624,845 | 5/1899 | Mosher | 248/228.3 |
| 2,202,000 | 5/1940 | Gray | 33/245 |
| 2,911,723 | 11/1959 | Ashbrook | 33/248 |
| 2,951,292 | 9/1960 | Buehler | 33/248 |
| 3,260,001 | 7/1966 | Weaver | 33/245 |
| 3,579,840 | 5/1971 | Heinzel | 33/50 |
| 3,671,000 | 6/1972 | Williams | 248/205 |
| 3,882,609 | 5/1975 | Troutman | 33/260 |
| 3,908,950 | 9/1975 | Apel | 248/291 |
| 4,026,055 | 5/1977 | Weast | 33/245 |
| 4,205,473 | 6/1980 | Wilson | 42/101 |
| 4,299,044 | 11/1981 | Johannsen | 33/250 |
| 4,353,180 | 10/1982 | Wilson | 42/101 |
| 4,367,606 | 1/1983 | Bechtel | 33/250 |
| 4,531,321 | 7/1985 | Bechtel | 42/101 |
| 4,835,895 | 6/1989 | Bowen | 42/101 |
| 4,905,396 | 3/1990 | Bechtel | 42/100 |
| 5,033,219 | 7/1991 | Johnson et al. | 42/103 |
| 5,035,487 | 7/1991 | Herz | 350/245 |
| 5,042,186 | 8/1991 | Bechtel | 42/103 |
| 5,134,798 | 8/1992 | Lee | 42/100 |
| 5,274,941 | 1/1994 | Moore | 42/101 |
| 5,355,607 | 10/1994 | Klotz | 42/101 |
| 5,375,361 | 12/1994 | Rustick | 42/101 |
| 5,400,539 | 3/1995 | Moore | 42/101 |
| 5,428,915 | 7/1995 | King | 42/101 |
| 5,465,519 | 11/1995 | Blanck | 42/70.11 |

FOREIGN PATENT DOCUMENTS

| | | | |
|---|---|---|---|
| 299177 | 5/1916 | Germany | 33/250 |
| 937659 | 9/1963 | United Kingdom | 33/245 |

*Primary Examiner*—Stephen M. Johnson
*Attorney, Agent, or Firm*—Young & Basile, P.C.

[57] ABSTRACT

An improved ring mount for mounting scopes and similar devices to firearms, comprising a vertically split mount having an upper ring portion, a lower mounting portion which can be drawn together for a transverse clamping action on a scope base, each clamping half comprising an integral, identical half. Draw bolts on the lower mounting portion are used to pull the clamping halves together in a pivoting motion from the top to the bottom of the ring mount which firmly clamps the scope in the ring portion prior to the lower mounting portion being lockingly clamped to the scope base. In a preferred form the ring mount is formed as a continuously extruded half with built in multiple height adjustments in the lower mounting portion, allowing the user to cut the extrusion into virtually any combination of lengths, ring spacings, height options. In a most preferred form the ring mount has two or more ring portions extending from an integral lower mounting portion, such that two identical halves can be fastened together to form an integral ring set.

10 Claims, 4 Drawing Sheets

SCOPE MOUNTING RING SYSTEM

FIELD OF THE INVENTION

The present invention is related to systems for mounting sighting devices such as scopes, optical sights and the like to firearms, and more particularly to an improved scope ring mount.

BACKGROUND OF THE INVENTION

As used herein, the term "scope" is to be understood as including all types of sighting devices capable of being mounted on a firearm, including but not limited to telescopic sights, optical sights, night vision devices, range finding and illuminating devices.

The standard and most widely used method for mounting scopes on firearms consists of a combination of a scope base and scope rings. A scope base is a platform securely attached to the firearm to provide a pre-configured mounting platform for the rings. The rings are typically formed as individual, horizontally split cylindrical clamps fastened around the scope body or "tube", with lower mounting portions which can be removably secured to the base.

There are many different scope ring/base combinations available commercially. One popular style known to those skilled in the art is the "Weaver" system, with longitudinal rail-type bases and rings transversely clamped to the rails. Another is the popular "rotary dovetail" style in which a base is provided with a ring-receiving slot, and a mating dovetail portion of the scope ring is dropped into the slot and rotated 90° into locking alignment with the receiver and barrel. Another style is the "Ruger® dovetail" system in which a dovetail "base" is actually machined into the firearm's receiver, and specially mated rings are clamped on with heavy screws.

Recently, AR-15 type rifles and their military M-16 counterparts have been manufactured with a "flattop" configuration in which the carrying handle is removed (or is removable), and the upper receiver surface is machined into a flat, Weaver style scope base configuration to accept different types of mounts or rings. The Weaver style configuration is common in the flattop design because many military scope systems are adapted for Weaver type mounts, and because the long flattop base allows the mounting of scopes of different lengths.

Another variation of scope mounting systems involves the "quick release" concept in which the rings (and the attached scope) can be mounted and dismounted without tools, or with simple tools, and quickly reattached without the need for re-zeroing the scope.

All of the foregoing systems have drawbacks or disadvantages fundamental to traditional ring mount systems. One problem is the need for rings of different heights to mount scopes with different objective lens diameters on the same firearm. For example, a scope with a small objective lens diameter or "bell" (e.g., 20–32 mm lens) might be mounted to a rifle using "low" height ring mounts; a medium bell (e.g., 33–42 mm lens) might require "medium" height ring mounts for the same firearm; and, a large-belled scope (e.g., 44–56 mm lens) would require a "high" ring mount. There are also times when it may be desirable to adjust the mounting height of the scope for the sighting comfort of the shooter, or to allow backup use of the firearm's metallic sights beneath the scope.

Another problem, particularly with Weaver-type bases and mounts, can be a lack of effective clamping length between the ring mount and the base. It is generally desirable to have strong uniform clamping between the ring mounts and base along a significant portion of the scope's length.

Another problem occurs during longitudinal adjustment of the scope relative to the base and the firearm. With prior art systems, the rings are fixed in place and the scope must be loosened from the rings enough for the scope to slide back and forth within the rings until proper eye relief is achieved. When the scope is loosened in this fashion, it is likely to be moved out of rotational alignment, i.e., where the crosshairs are no longer "square" to the receiver. This can result in a significant loss of accuracy for long range shooting. It is also a time consuming task to re-align the crosshairs.

Another problem is ring misalignment, in which the spaced rings are not coaxial. Unless corrected, this can result in mechanical stress and distortion of the scope tube upon tightening, thereby damaging the scope.

Yet another problem is the high manufacturing cost associated with scope rings, which require precise machining. These and other problems are solved by the present invention described below.

SUMMARY OF THE INVENTION

The present invention is an improved ring mount system which is rugged, quick detachable, height adjustable, optionally see-through, and re-zeroed upon reattachment. It is additionally inexpensive to manufacture, easily machined in a variety of configuration options, and eliminates the need to loosen the scope from the rings for longitudinal eye relief adjustment.

In general the invention comprises a vertically split ring mount comprising two symmetrical clamping halves, the upper portion of which forms a ring for clamping around the scope tube, and the lower portion of which forms a mounting portion for clamping to the base on the firearm. The vertically split clamping halves are initially secured at the top of the ring such that the mount is progressively tightened from top to bottom and loosened from bottom to top. Tightening is achieved with bolt means passing through mating apertures in the mounting portion of the clamping halves.

In a further embodiment of the invention, the ring mount has multiple, vertically spaced base-clamping surfaces to provide multiple height adjustments in a single ring mount.

In a preferred form of the invention, multiple ring halves are formed in a continuous, integral clamping half to provide a rigid set of multiple rings when two halves are assembled. This integral ring set can further be provided with a large number of draw-bolts spaced along the continuous mounting portion for uniform clamping force along the entire mounted portion of the scope. A further advantage of the integral ring set is an integral, aligned set of rings which will not stress or distort the scope tube. Yet a further advantage of the integral ring set is the ability to fine tune the entire mount for custom-fit slide adjustment on a particular scope base, without loosening the scope in the rings.

In a further form of the invention the split halves are provided with a quick-detach locking lever in addition to the clamping bolts. Once the clamping bolts are tightened to the point where they provide a smooth, zero-maintaining slide adjustment on the scope base, the quick-detach lever is used for final tightening and initial loosening of the ring mount on the base.

The split clamping design of the present system, along with the multiple height adjustments, allows for see-through mounting to take advantage of the firearm's metallic sights using a "tunnel" between the clamping halves and the base. This arrangement also will allow the ring mount of the present invention to be adapted to a variety of bases, simply by machining the base-clamping surfaces of the mounting portion to mate with a particular style of base. In some cases it may also allow a ring mount to be secured directly to the firearm receiver without the need for a base, provided the clamping surfaces of the mount can be machined to mate securely with a portion of the receiver.

In another aspect the identical clamping halves of the inventive ring mount system are formed from a uniform, continuous extrusion which can be custom cut to length and height for different scope bases and/or scopes. For example, a particular scope base may require a continuous mount length of at least four inches, while the scope requires a ring spacing of three inches to accommodate windage and elevation adjustment turrets and possibly some protruding feature of the firearm. In this case the base mounting portion can be cut to a first length from the continuous extrusion, while the ring portion can be cut to a different length on the top half of the extrusion.

In the preferred form the inventive ring mount system is formed from a suitably hardened aluminum alloy capable of being extruded and machined to desired tolerances.

These and other advantages of the present invention will become apparent upon a further reading of the specification.

DETAILED DESCRIPTION OF THE ILLUSTRATED EMBODIMENT

Figure 1:
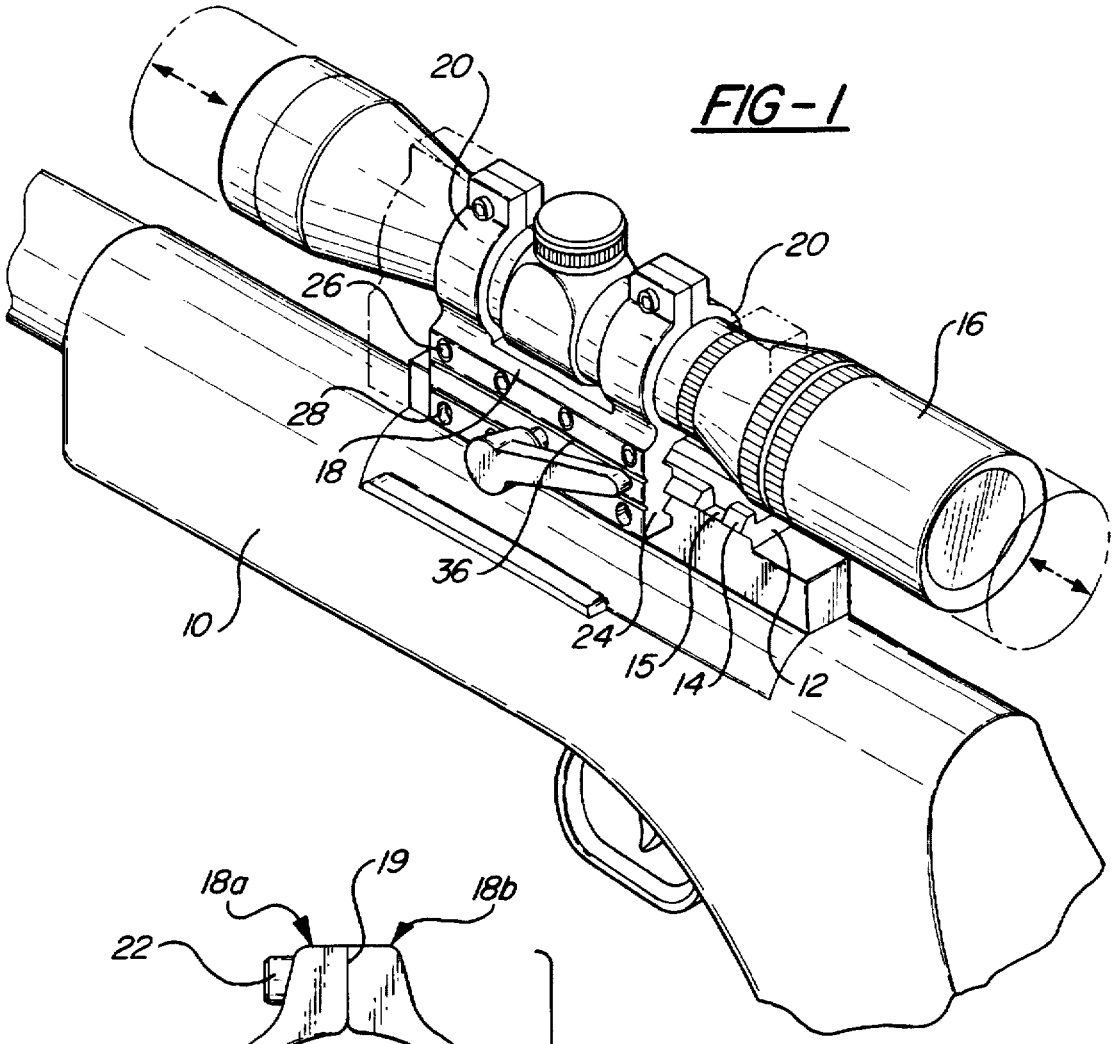
FIG. 1 is a perspective view of a ring mount system according to the present invention, securing a scope to a base on a rifle.
Figure 2:
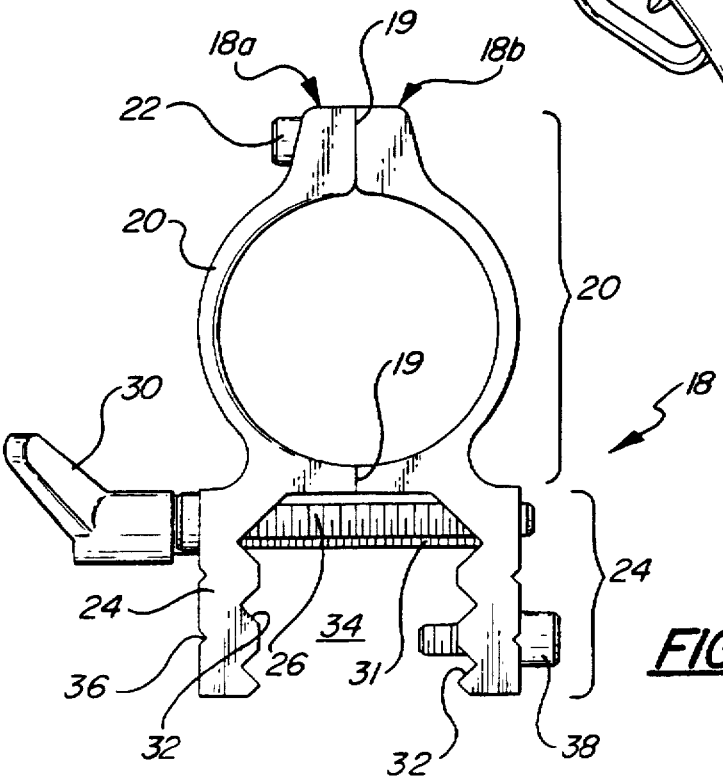
FIG. 2 is an end view of the ring mount of FIG. 1.
Figure 3:
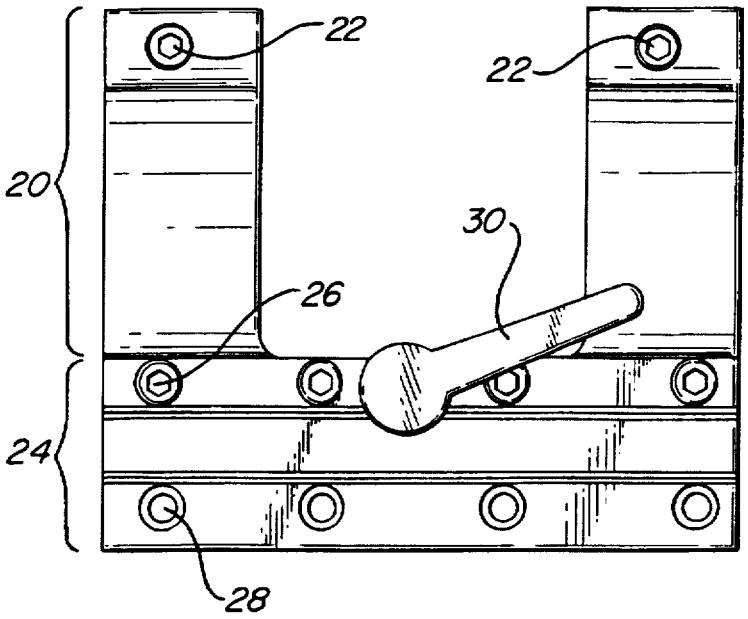
FIG. 3 is a side elevational view of the ring mount of FIG. 2.

Referring to FIGS. 1–3, a firearm 10, in the illustrated embodiment a rifle, is provided with a Weaver-style base 12 secured to the receiver in known manner. Weaver-style base 12 has a pair of longitudinal siderails 14 with a somewhat V-shaped horizontal profile, best shown in FIG. 5. Siderails 14 may or may not be interrupted by transverse slots 15, depending on the base. While the illustrated embodiment of the invention is shown as adapted for a Weaver-style base, it will be understood by those skilled in the art that the present invention can be formed to mate with virtually any style base to which rings are attached with a transverse clamping action. However, long, rail-type bases such as that illustrated, or the AR-15 flattop style described above, are preferred.

A sighting device 16, in the illustrated embodiment a compact telescopic sight (hereinafter "scope"), is secured to base 12, and therefore to firearm 10, by inventive ring mount 18. Ring mount 18 comprises vertically split, identical clamping halves 18a, 18b with upper ring portions 20 and lower base-mounting portions 24. The clamping halves are symmetrically split along seam 19.

Ring portions 20 are clamped together at their upper ends with a set screw 22, while mounting portions 24 are drawn together with throughbolts 26 threaded through matching holes 28 along each side of the mount. Two rows of holes 28 are shown in the illustrated embodiment to accommodate different mounting heights discussed below.

An additional clamping adjustment is provided with quick-detach handle 30 of a known type, which selectively rotates a larger throughbolt 31 threaded through the center of both halves of ring mount 18.

Referring more particularly to FIG. 2, the lower mounting portion 24 of ring mount 18 is generally rectangular in cross-section with a series of longitudinal dovetail grooves 32 having a cross-section matching the rail sections 14 on Weaver-style base 12. The height of base-mounting portion 24 provides the option of a see-through "tunnel" 34 underneath rings 20, which enables the shooter to look underneath the scope and through the scope mount to aim the firearm with the standard metallic sights on the receiver and/or barrel.

In the illustrated embodiment there are three sets of vertically-spaced dovetail clamping grooves 32 in the mount, which provide three levels of height adjustment for ring mount 18 to accommodate different scope sizes or different shooter preferences in scope height. The inventive system is not limited to only three levels of height adjustment, but the three levels illustrated (low, medium, high) will be suitable for most applications. The relative height and spacing of grooves 32 can of course vary as desired to accommodate anticipated height adjustments.

Figure 7:
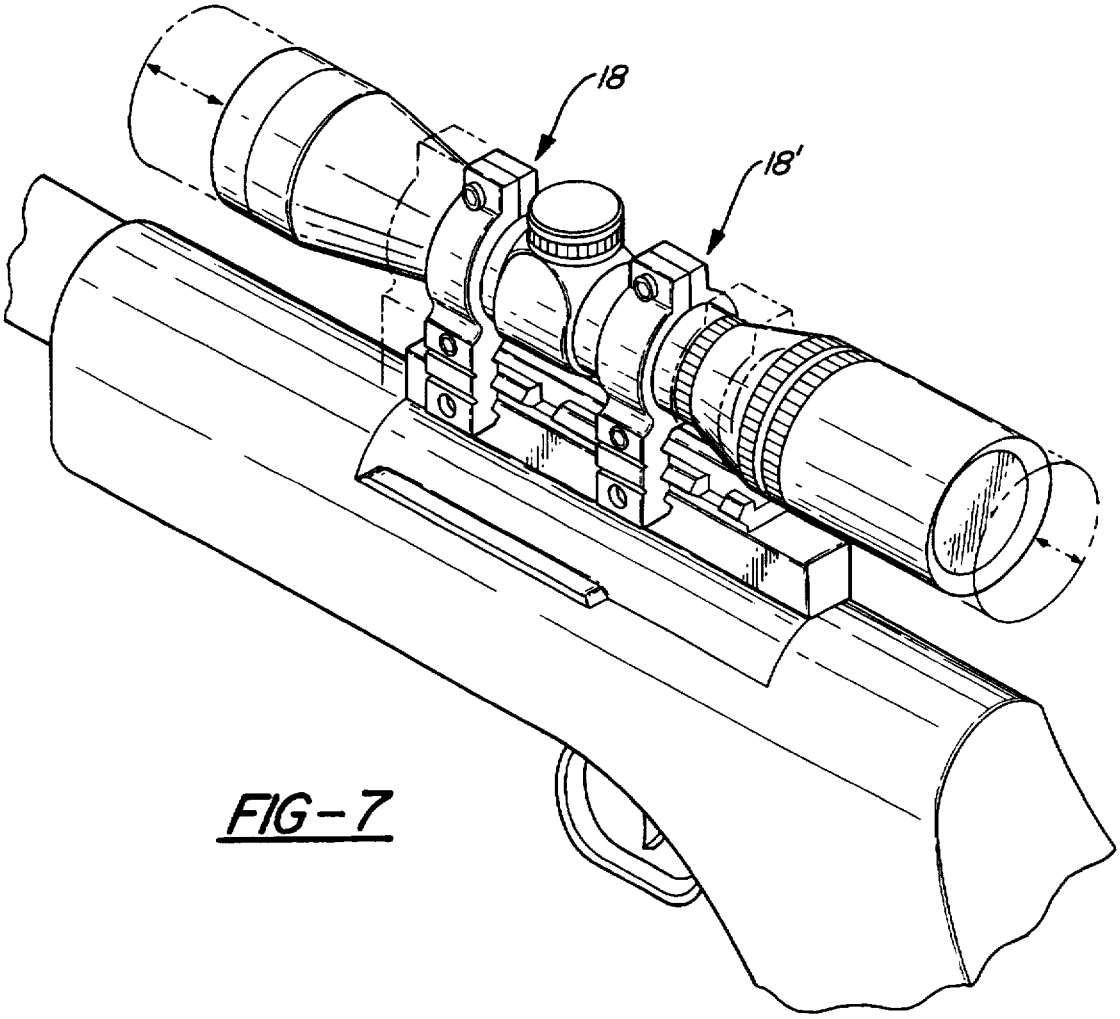
FIG. 7 is a perspective view of an alternate ring mount system according to the present invention comprising independent rings.

Ring mount 18 is mounted on base 12 in a slide fit illustrated in phantom and by arrows in FIGS. 1 and 7, with rails 14 dovetailing into one set of grooves 32.

It can also be seen in FIGS. 1–3, particularly FIG. 2, that a number of shallow grooves 36 are formed along the outside surface of mounting portion 24, vertically spaced to lie between the inside clamping grooves 32. These pre-machined grooves aid in cutting off unwanted sections of mounting portion 24 if one or more levels of height adjustment is not needed. Although the built-in height adjustment via multiple sets of grooves 32 is preferred, it will be understood that the invention can be made without the optional height adjustment capability.

FIG. 2 also illustrates a safety screw 38 designed to engage one of the transverse slots 15 in the Weaver type rail as a shear-stop. Should the ring mount 18 somehow loosen on the base after prolonged firing, or if the shooter has improperly tightened the mount to the scope base, the screw 38 will keep the ring mount and scope from sliding off the base under recoil. Safety screw 38 can be mounted in any of holes 28 not occupied by a bolt 26.

Figure 4:
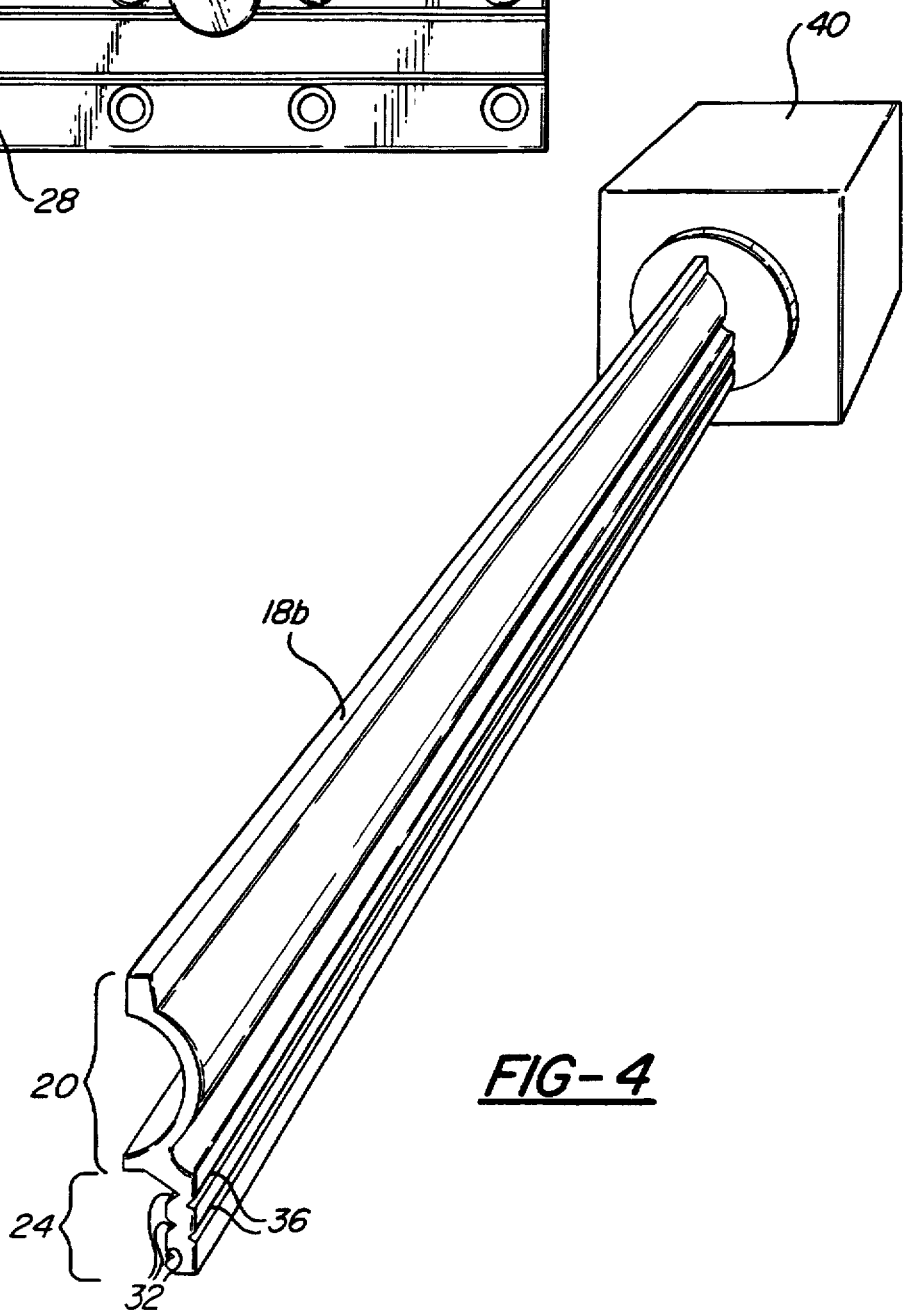
FIG. 4 is a perspective view of the continuous extrusion from which the ring mount of FIG. 1 is formed.

Referring now to FIG. 4, a preferred method of manufacturing the present ring mount is schematically illustrated in an extrusion process. The ring mount 18 of FIGS. 1–3, comprising vertically split, identical halves, can be integrally and continuously extruded in a conventional extrusion process 40 and then machined to the desired length. In this regard the cross-section of the ring mount halves is in itself inventive, as it permits a single ring mount half to be continuously extruded and then cut or machined into any number of desired lengths or ring-spacing combinations. It also lends itself to being cut as a continuous, integral ring mount set 18 as shown in FIGS. 1–3, or as individual, separate ring mounts 18, 18' as illustrated in FIG. 7.

Figure 4B:
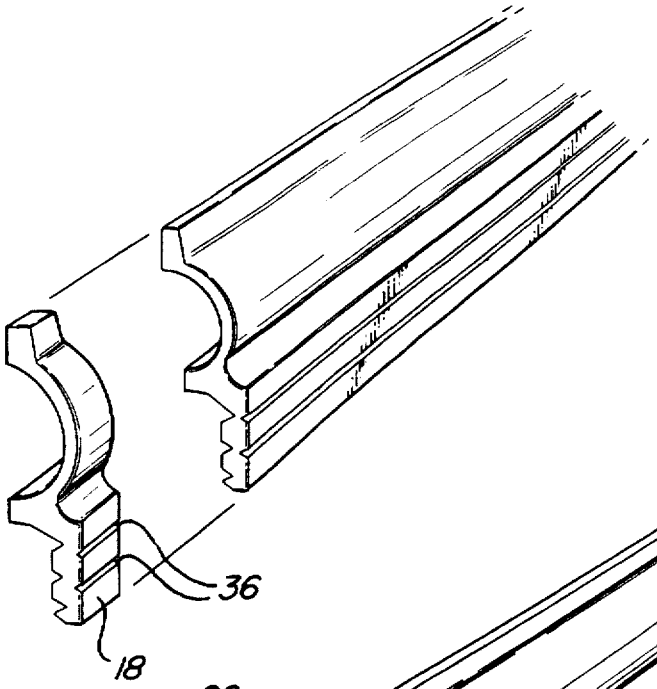
FIGS. 4A and 4B represent two possible mounts cut from the continuous extrusion of FIG. 4.
Figure 4A:
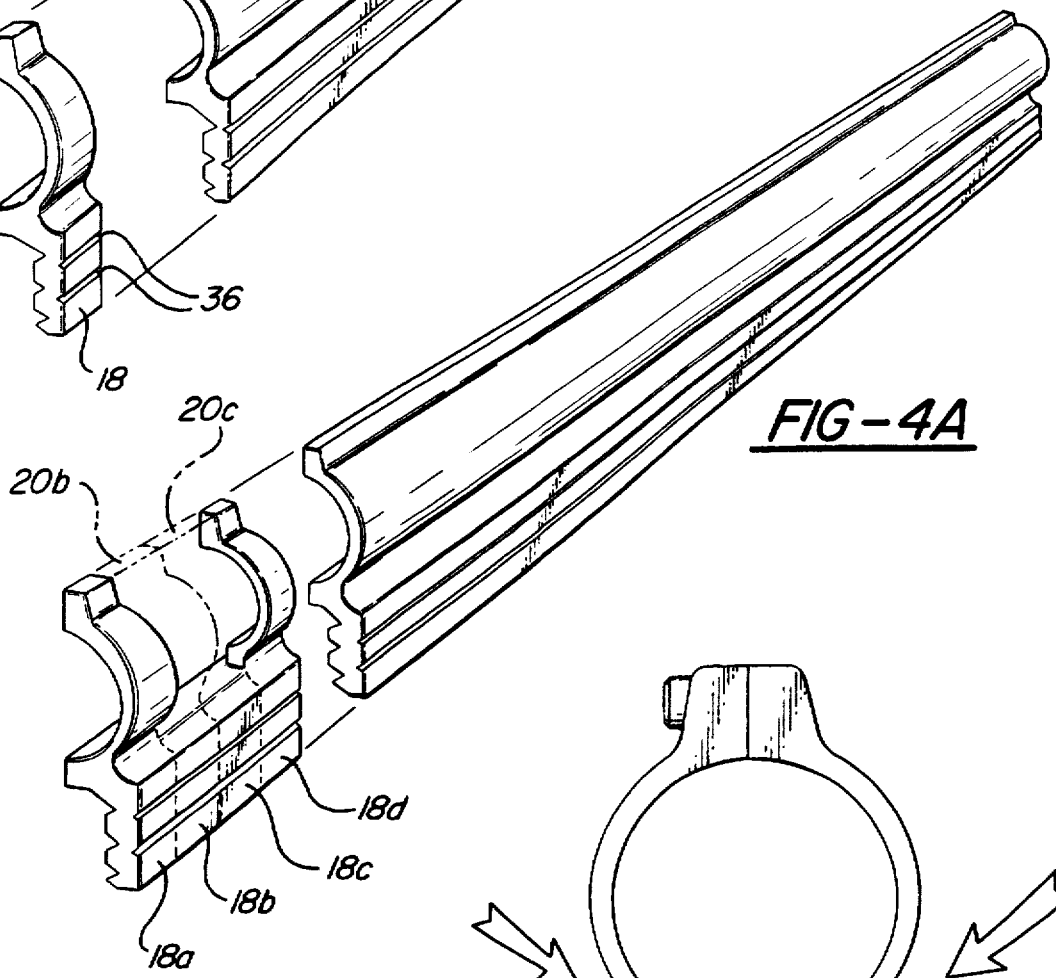

Two examples of the possible combinations of overall length and ring spacing are shown in FIGS. 4A and 4B. FIG. 4A illustrates a continuous, integral ring set 18 like that shown in FIGS. 1–3, in which four sections 18ad are cut from the extrusion as a continuous piece, and then two interior ring sections 20*b*, 20*c* are removed from the upper ring portion 20 to leave two spaced rings 20. Referring to FIG. 4B, sections 18 are cut off one at a time to form a number of independent, single-ring halves. It will accordingly be understood by those skilled in the art that virtually any ring spacing or number of rings can be built into the ring mount 18 simply by cutting the uniform, continuous extrusion as desired. The various throughholes needed for screw 22, bolts 26 and 31, and set screw 38 are subsequently drilled and tapped.

In the illustrated embodiment, the ring mount extrusion is formed from a suitably hardened aluminum alloy. It will also be understood by those skilled in the art that the inventive ring mount system can be formed in more conventional fashion, for example by casting and/or machining from aluminum or steel.

Figure 5:
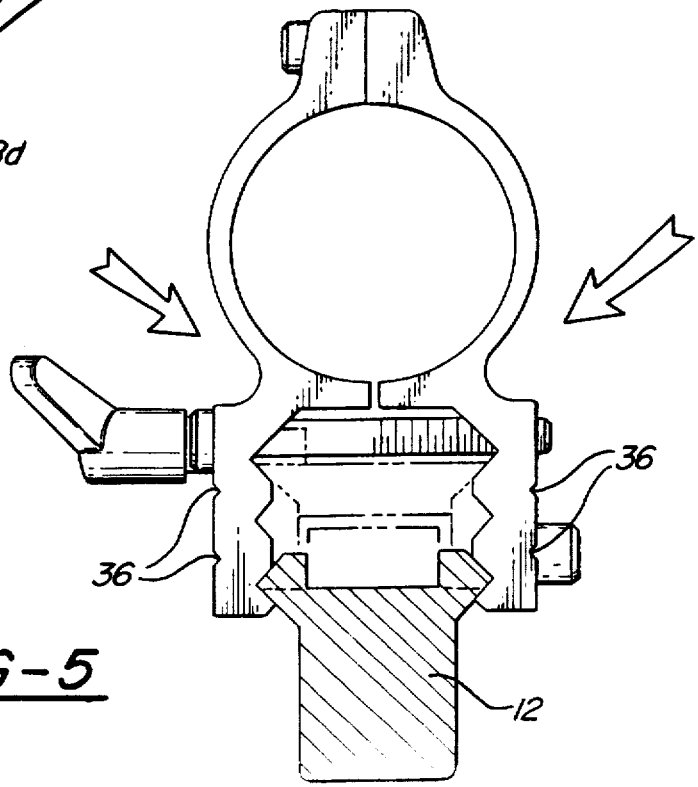
FIG. 5 is an end view of the ring mount of FIG. 1 showing the clamping motion around a scope and base.
Figure 6:
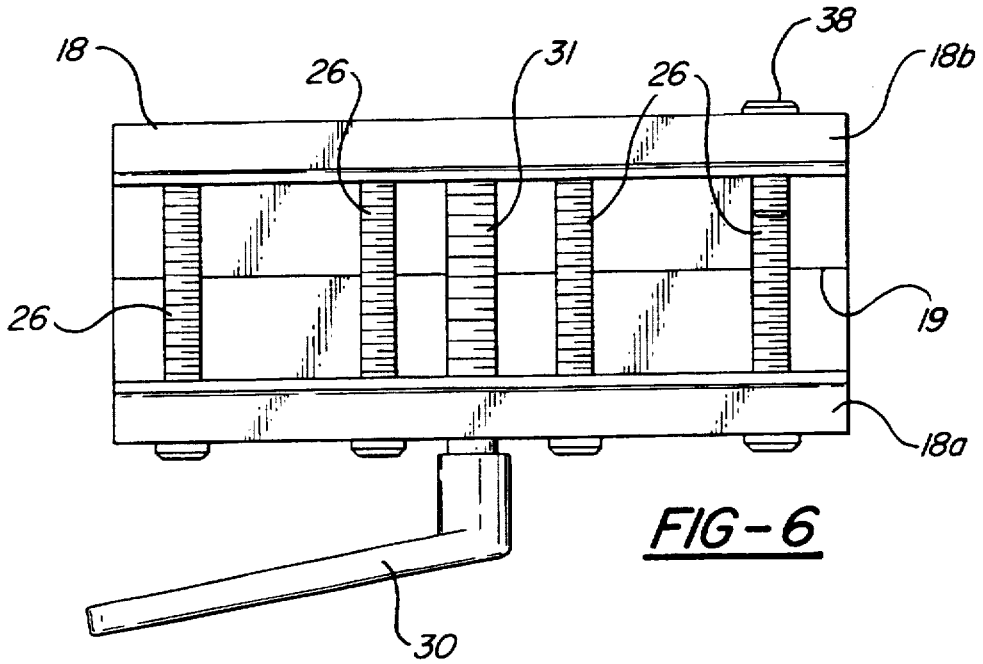
FIG. 6 is a bottom view of the ring mount of FIG. 1.

Referring now to FIG. 5, the ring mount of FIG. 1 is illustrated in end view while being assembled. Ring portions 20 are first placed loosely over the scope tube or body, and initially fastened together by upper set screw 22. Mounting portions 24 are next connected with throughbolts 26 to a point where they form a connected unit which can slide onto or be clamped over the Weaver-type base, with the desired set of clamping grooves 32 selected for height. Throughbolts 26 are then further tightened so that ring mount 18 is uniformly clamped to rail 12 along its entire length.

In embodiments using the additional tightening mechanism of quick-detach handle 30, throughbolts 26 are individually tightened for a uniform slide-adjustable fit with rails 14 or base 12, the final tightening step being accomplished with quick-detach handle 30 and its large throughbolt 31. In this manner the quick-detach handle 30 can be rotated a half turn or so to loosen the mount 18 just enough to slide the mount and scope to the desired position along base 12, and then securely re-fasten it with another simple half-turn.

One advantage of the uniform slide adjustment pre-clamp performed with throughbolts 26 is a custom, uniform fit to an individual base 12, such that slide adjustment does not change the zero of the scope relative to the rifle. The scope accordingly retains its zero throughout its range of adjustment on the base. The multiple, full length, independently adjustable array of lock points via throughbolts 26 ensures uniform clamping along the entire length of the mount on the base. In some cases it may be necessary to achieve proper eye relief by extending a portion of the ring mount beyond the base; in such a case, the multiple lock points still engaged on the base will maintain a secure connection. This would not be possible with the typical two-point ring mounting arrangement of prior art systems if one of the ring mounts were extended beyond the base.

An additional advantage of the vertically split, slide-adjustable ring mount 18, particularly when formed as a continuous ring set as shown in FIGS. 1–3, is the elimination of the need to loosen the scope within the rings for eye relief adjustment, and the associated possibility of rotational misalignment of the crosshairs. The procedure of re-squaring the cross hairs after scope adjustment is one that has cost many frustrated shooters hours of effort with bubble levels, boresighters and the like. The present invention eliminates that tedious work.

FIG. 7 illustrates an alternate ring mounting arrangement using the ring mount of the present invention. Two individual ring mounts 18, 18' are attached at spaced locations to the scope body. The use of individual ring sets provides the shooter with a greater measure of flexibility in terms of placing the rings on the scope, which can be important with some types of bases.

Although the individual ring sets of FIG. 7 are advantageous in some circumstances, the integral ring set 18 of FIGS. 1–3 is preferred, for the reasons discussed above (custom fit slide-adjustment, rigidity, uniform full-length clamping) and the fact that the integrally-extruded ring halves (and the assembled ring) provide a positive, built-in coaxial alignment not found with individual ring systems. The built-in coaxial alignment of the rings in the integral ring set eliminates stress and mechanical distortion of the scope body due to misaligned ring axes. Not only does this eliminate stress on the scope body when the scope is initially mounted and secured within the rings, but it eliminates subsequent damage due to any torque arm or leverage effect against the scope body under re-coil while the firearm is being fired.

The foregoing description is of an illustrative embodiment of the invention, and it should be understood that the invention is not to be limited except as provided by the following claims. For example, although a Weaver style mounting arrangement is illustrated, it is possible to use the invention with other styles of bases, or to fit them directly to existing structure on the firearms, simply by forming the base mounting portion to mate accordingly.

I claim:

1. An improved ring mount for mounting scopes to firearms, comprising:

a ring mount comprising two vertically split clamping halves, an upper portion of which comprises a ring portion for clamping around the scope, and a lower portion of which comprises a mounting portion with base-clamping surfaces for mating with a base on the firearm, the lower mounting portion including means for drawing the clamping halves together to secure the ring mount to the base on the firearm, wherein the mounting portion includes multiple base-clamping surfaces arranged in vertically-spaced sets to provide multiple height adjustments on the base.

2. Apparatus as defined in claim 1, wherein the lower mounting portion has a length greater than the upper ring portion.

3. Apparatus as defined in claims 1, wherein multiple ring halves are formed on a single, integral clamping half, and the mounting portion is provided with an upper lengthwise array of lock points for uniformly clamping the mount to the base along its length, and a lower array of lock points associated with a lower set of the vertically-spaced base-clamping surfaces.

4. An improved ring mount for mounting scopes to firearms, comprising:

a ring mount comprising two vertically split clamping halves, an upper portion of each clamping half comprising two spaced, vertically split ring portion halves for clamping around the scope, and a lower portion of each clamping half comprising a vertically split mounting portion half integrally connecting the two spaced, vertically split ring portion halves and having one or more base-clamping surfaces for mating with a base on the firearm, the mounting portion halves further including means for drawing the clamping halves together to secure the ring mount to the base on the firearm.

5. Apparatus as defined in claim 4, wherein the means for drawing the clamping halves together comprises means for drawing the clamping halves together with uniform force substantially along the full length of the ring mount.

6. Apparatus as defined in claim 5, wherein the means for drawing the clamping halves together with uniform force substantially along the full length of the mount comprises a plurality of throughbolts spaced evenly along the length of the mount, and further including a quick-detach handle for adjusting the clamping force of the mount independently of the throughbolts such that the throughbolts can be tightened for a close sliding fit with the base on the firearm and the quick-detach handle is operable to adjust the clamping force between the sliding fit and a fastened condition.

7. Apparatus as defined in claim 6, wherein the throughbolts are spaced along the length of the mount such that at least one of the throughbolts is located between adjacent ring portions on the mount.

8. Apparatus as defined in claim 6, wherein the quick-detach handle is located between adjacent ring portions on the mount.

9. Apparatus as defined in claim 6, wherein the mounting portion includes multiple base-clamping surfaces arranged in vertically-spaced sets to provide multiple height adjustments on the base.

10. Apparatus as defined in claim 9, wherein the mounting portion includes vertically-spaced sets of mounting holes for the throughbolts.

* * * * *